United States Patent [19]

Gray

[11] Patent Number: 4,835,805

[45] **Date of Patent: * Jun. 6, 1989**

[54] PRODUCTION OF THREADED METAL RODS FOR MAKING U-BOLTS

[76] Inventor: John C. Gray, 3050 Dryden Rd., Dayton, Ohio 45439

[ * ] Notice: The portion of the term of this patent subsequent to Apr. 7, 2004 has been disclaimed.

[21] Appl. No.: 203,241

[22] Filed: Jun. 6, 1988

Related U.S. Application Data

[63] Continuation-in-part of Ser. No. 31,599, Mar. 30, 1987, Pat. No. 4,748,707, which is a continuation of Ser. No. 876,739, Jun. 20, 1986, Pat. No. 4,654,912, which is a continuation of Ser. No. 651,796, Sep. 18, 1984, abandoned, which is a continuation of Ser. No. 412,998, Aug. 30, 1982, abandoned, which is a continuation-in-part of Ser. No. 173,639, Jul. 30, 1980, abandoned.

[51] Int. Cl.[4] ..... B21K 1/74; B21D 9/08

[52] U.S. Cl. ..... 10/27 UB; 72/31; 72/213

[58] Field of Search ..... 10/27 R, 27 UB; 72/31, 72/32, 34, 37, 212, 213; 156/187; 411/389, 400

[56] References Cited

U.S. PATENT DOCUMENTS

| | | | |
|---|---|---|---|
| 4,643,786 | 2/1987 | Cecchi | 156/187 |
| 4,654,912 | 4/1987 | Gray | 10/27 UB |
| 4,748,707 | 6/1988 | Gray | 10/27 UB |

*Primary Examiner*—E. Michael Combs

*Attorney, Agent, or Firm*—Jacox & Meckstroth

[57] ABSTRACT

Elongated straight cylindrical metal rods are threaded along opposite end portions, and the cylindrical outer surface of the center portion of each rod is marked to form a visual indicator of the longitudinal center of the rod. The straight rods are successively inserted into a rod bearing machine having a mandrel with a mark indicating the center plane of the bending operation. The mid-point mark on each rod is aligned with the center plane mark on the machine, and the rod is bent to form a precision U-bolt. Preferably, the mark identifying the center of each rod extends circumferentially around the metal rod and is formed by a stripe or color contrasting ink directly on the rod or on a label attached to the rod to provide a permanent mark which does not require rotating the rod to find the mark.

5 Claims, 3 Drawing Sheets

PRODUCTION OF THREADED METAL RODS FOR MAKING U-BOLTS

RELATED APPLICATIONS

This application is a continuation-in-part of application Ser. No. 031,599, filed Mar. 30, 1987, now U.S. Pat. No. 4,748,707, which is a continuation of application Ser. No. 876,739, filed June 20, 1986, now U.S. Pat. No. 4,654,912, which is a continuation of application Ser. No. 651,796, filed Sept. 18, 1984, abandoned, which is a continuation of application Ser. No. 412,998, filed Aug. 30, 1982, abandoned, which is a continuation-in-part of application Ser. No. 173,639, filed July 30, 1980, abandoned.

BACKGROUND OF THE INVENTION

In the manufacture of large steel U-bolts of the type, for example, used to secure a semi-trailer body to a wheel supported frame or to secure a leaf spring to a wheel supported axle, it is common to cut a long steel rod having a diameter, for example, between ⅜ inch and 1¼ inches into rod sections or shorter rods each of which is threaded along opposite end portions while the rod remains straight. The threaded straight rods are then successively inserted into a hydraulically or power operated rod bending machine which bends or cold-forms each rod around a U-shaped mandrel to produce a U-bolt.

In order to position each rod within the bending machine, the operator may use a tape measure to position the rod so that the mid-point of the rod is aligned with the center of the mandrel. This measuring operation requires significant time. Some bending machines are also equipped with an adjustable stop which is used for locating one end of each rod to position the rod properly within the bending machine. When rods of different lengths are successively formed into U-bolts, it is necessary to adjust the end stop according to the length of each rod. Sometimes it is necessary to adjust the end stop frequently since the rods are commonly bent in sets of two or four rods, and each set may have a different length.

It has been found that as a result of a machine operator making an inaccurate measurement of the length of a rod or an incorrect adjustment of the end stop, a number of straight rods are formed into U-bolts without having the center point of the straight rod aligned precisely with the center plane of the rod bending machine. As a result, the U-bolts are formed with one leg longer than the other, and frequently, the improperly bent U-bolts cannot be used and must be scrapped since the bolts cannot be restraightened and reformed.

SUMMARY OF THE INVENTION

The present invention is directed to the production of metal U-bolts and provides for a more efficient and economical method of producing U-bolts by substantially reducing the scrap rate of incorrectly formed or bent U-bolts and significantly reducing the bending time. The method of the invention eliminates the need for measuring each straight threaded rod before bending it into a U-bolt or eliminates the need for adjusting an end stop for each straight rod according to the length of the rod.

In general, these advantages are provided in accordance with one embodiment of the invention by permanently marking each straight threaded rod to indicate the longitudinal center point or radial center plane of the rod. The marking or mark on each rod provides the rod with an easily visible indicator of the radially extending center plane of the rod, and the mark is simply aligned with a mark located on the center of the mandrel of the rod bending machine, prior to bending the straight threaded rod into a U-bolt.

Other features and advantages of the invention will be apparent from the following description, the accompanying drawing and the appended claims.

DESCRIPTION OF THE PREFERRED EMBODIMENTS

Figure 1:
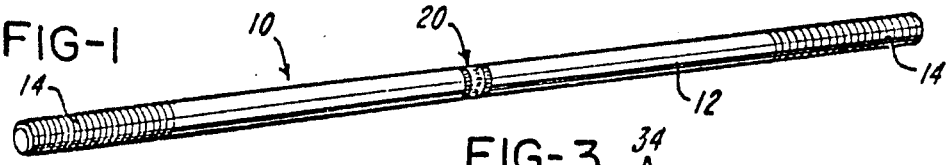
FIG. 1 is a perspective view of a straight metal rod having opposite threaded end portions and a center portion with a permanent mark indicating the longitudinal center of the rod in accordance with the invention.
Figure 5:
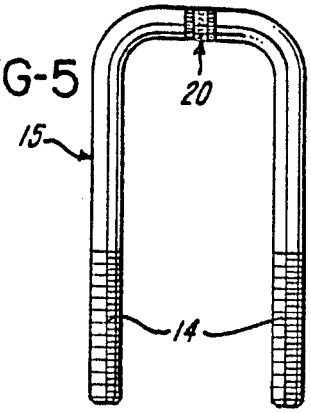
FIG. 5 is a side view of a U-bolt formed with the rod shown in FIG. 1.

Referring to FIG. 1, a cylindrical metal or steel rod 10 has a smooth cylindrical outer surface forming a center portion 12 between opposite threaded end portions 14. As mentioned above, the threaded metal rods are commonly manufactured in a wide range of diameters, for example, from ⅜ inch to 1¼ inches and in different steel compositions according to the uses or applications of the rods after they are bent or cold-formed into U-bolts such as the U-bolt 15 illustrated in FIG. 5.

Figure 2:
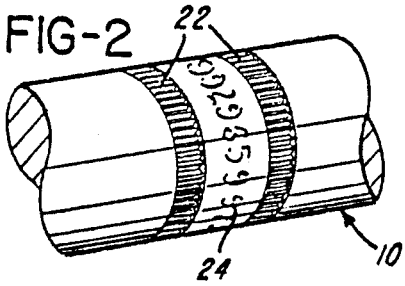
FIG. 2 is an enlarged fragmentary perspective view of the center portion of the rod shown in FIG. 1 and illustrating the permanent mark for indicating the center plane of the rod.

In accordance with the present invention, the rod 10 has a diameter of at least one half inch and a visual indicating mark 20 which identifies the longitudinal center of the rod 10 or the radially extending center plane. As shown in FIG. 2, one type of center indicating mark 20 is formed by two axially spaced and circumferentially extending knurls 22 which are embossed or impressed into the outer cylindrical surface of the rod 10. An identification or code number 24 extends circumferentially between the knurls 22 and lies within the radially extending center plane of the rod 10. Preferably, the number 24 identifies the particular steel used for forming the straight rod 10. However, the circumferentially extending number 24 may also identify other information, such as the diameter and length of the rod 10 or the part number for the final U-bolt 15 or the date of manufacture.

Figure 3:
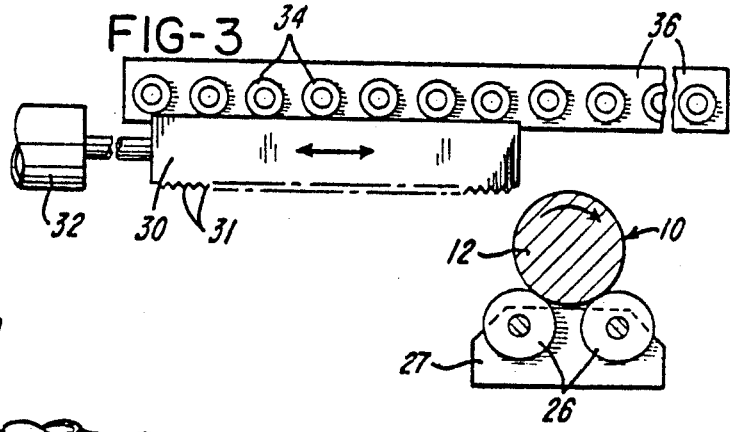
FIG. 3 is a diagrammatic view of a device for applying the permanent center indicating mark on the rod shown in FIGS. 1 and 2.

The rod center indicating mark 20 is preferably applied to the rod before the end portions are threaded and after the rod is cut to a predetermined length from a longer steel rod. A supply of the rods 10 successively receive the mark 20 within a machine or power operated device wherein each of the rods 10 is rotatably supported by a set of cradle forming rollers 26 (FIG. 3) mounted on frame members 27. An elongated metal dye 30 has two parallel rows of parallel teeth 31 and is moved linearly by a double acting fluid cylinder 32 into tangential engagement with the rod 10 so that the teeth 31 form the circumferentially extending knurls 22. The dye 30 also carries a row of outwardly projecting characters (not shown) located between the rows of teeth 31, and the characters form or impress the code number 24 within the outer surface of the rod 10. A series of backup rollers 34 are supported in a row by a frame member 36 and function to guide the dye 30 so that the teeth 31 and the outwardly projecting characters are pressed into the outer surface of the rod 10 to deform or emboss the metal.

Figure 4:
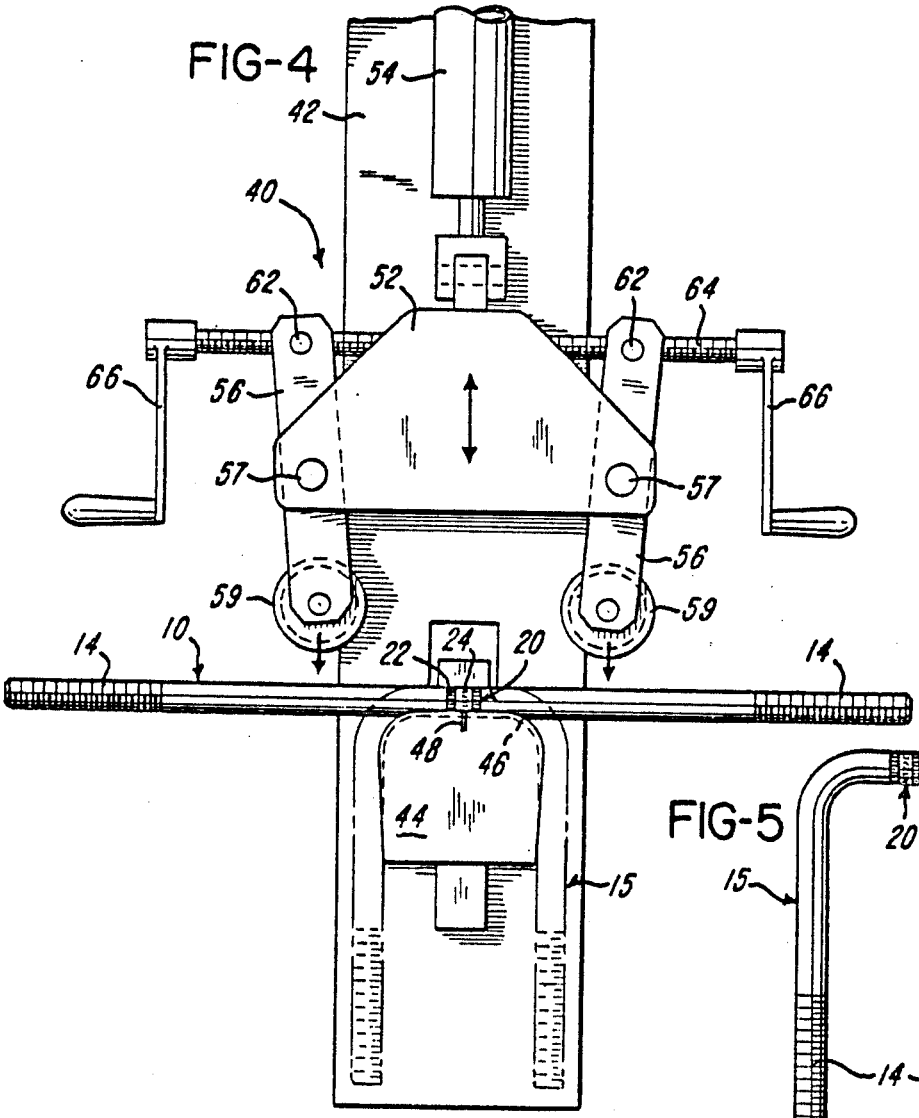
FIG. 4 is an elevational view of one form of rod bending machine for producing a U-bolt.

After a supply of rods 10 are successively embossed with corresponding marks 20, and the outer end portions of the rods are threaded to form the threaded end portions 14, the rods are ready to be successively cold-formed or bent into U-bolts. One form of rod bending machine 40 is illustrated in FIG. 4. The bending machine 40 includes a base plate or beam 42 which supports an interchangeable steel die or mandrel 44 having a U-shaped rod locating groove 46. The mandrel 44, or an adjacent movable bar clamping block, has a mark or indicator 48 which identifies the center plane of the bending machine 40 or bending operation.

A carriage 52 is supported by the base plate 42 for reciprocating movement in response to actuation of a double acting fluid cylinder 54. The carriage 52 includes a set of lever arms 56 which are pivotally supported by corresponding pivot pins 57. The lower end portions of the arms 56 carry a corresponding pair of grooved forming rollers 59, and the upper end portions of the arms 56 support pivotal nuts 62 which receive oppositely threaded end portions of a rotatable adjusting screw 64. A set of crank arms 66 are secured to opposite ends of the screw 64 and provide for adjusting or pivoting the arms 56 and adjusting the spacing between the forming rollers 59 according to the size or width of the selected mandrel 44.

As illustrated in FIG. 4, a supply of the rods 10 shown in FIG. 1 are successively inserted into the bending machine 40 where each rod 10 rests on the grooved mandrel 44. The code number 24 of the mark 20 is aligned with the center indicator 48 on the mandrel 44, as shown in FIG. 4. The cylinder 54 is then actuated to move the carriage 52 towards the mandrel 44 so that the rollers 59 form or bend the rod around the mandrel 44 to form the U-bolt 15. After the carriage 52 is retracted, the U-bolt is removed from the mandrel 44, and the next straight rod 10 is inserted into the bending machine 40.

Figure 6:
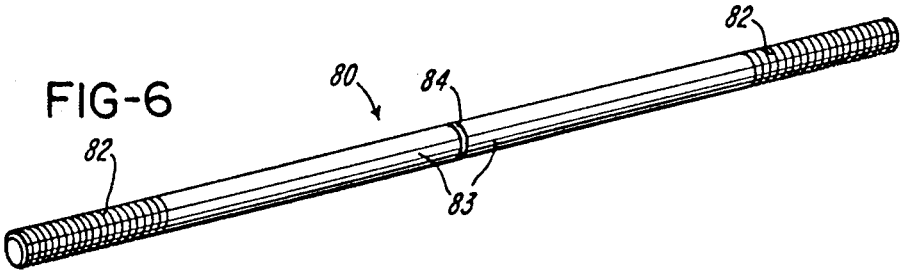
FIG. 6 is a perspective view similar to FIG. 1 and showing a threaded rod having another form of center indicating mark.

FIG. 6 illustrates another cylindrical metal or steel rod 80 which is constructed substantially the same as the steel rod 10 and has opposite threaded end portions 82. The rod 80 has a smooth outer surface 83 which is provided with a center indicating mark 84 in the form of an ink stripe extending circumferentially completely around the rod. The ink stripe 84 is applied to the rod after the cylindrical outer surface 83 is cleaned, and the color of the ink provides a distinctive contrast with the color of the rod 80, such as, for example, a yellow ink stripe on the dark gray color of the steel rod.

Figure 7:
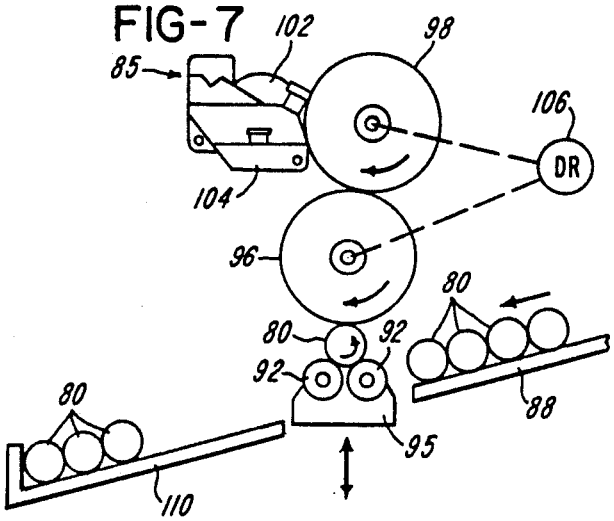
FIG. 7 is a diagrammatic end view of a machine for marking a supply of threaded rods.
Figure 8:
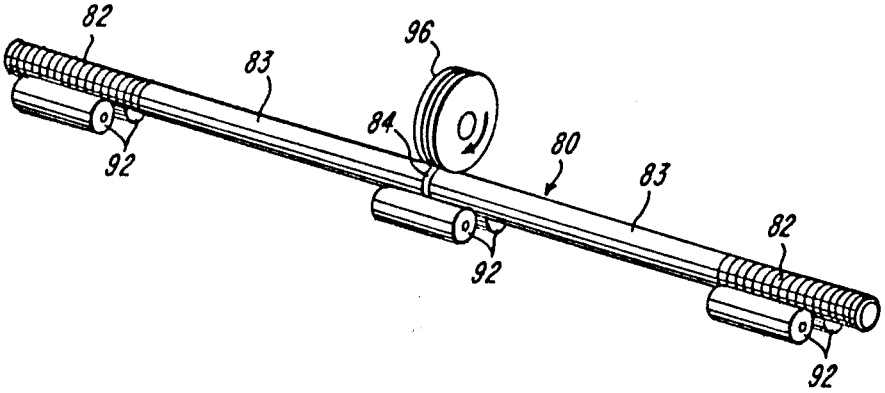
FIG. 8 is a diagrammatic perspective view of the marking operation shown in FIG. 7.

Center indicating marks 84 are successively applied to a supply of rods 80 with a marking machine having a marking head 85 which is generally illustrated in FIG. 7. The rods 80 are supplied to the marking head 85 on an inclined ramp 88 and are successively transferred by a transfer mechanism (not shown) to a cradle support formed by a set of axially spaced pairs of freely rotating cradle rollers 92. The rollers 92 are supported by a carriage 95 which moves vertically to bring each rod 80 into contact with a printing wheel 96 forming part of the marking head 85 of the marking machine. The printing wheel 96 receives ink from a transfer wheel 98 which, in turn, receives ink from an applicating wheel 102 projecting into an ink supply reservoir 104.

The printing wheel 96 and the wheels 98 and 102 are driven by a drive 106 such as an air motor and gear reducer unit. As each rod 80 is moved into contact with the printing wheel 96 by upward movement of the carriage 95, the driven wheel 96 rotates the rod 80 supported by the cradle rollers 92 while also applying or printing the circumferentially extending stripe or center indicating mark 84 on the rod. After the printing operation, the carriage 94 is lowered, and the printed rod 80 is transferred laterally from the cradle rollers 92 by the transfer mechanism to a ramp 110 which collects the printed rods 80 each having a center indicating mark 84.

In place of supporting the cradle rollers 92 by a vertical movable carriage 94, the cradle rollers 92 may be supported in a fixed position, and the marking head 85, including printing wheels 96, 98 and 102 and reservoir 104, may be supported for vertical or pivotal movement so that the power driven printing wheel 96 moves downwardly into engagement with each rod 80 after it is transferred to the cradle rollers 92. In order for the marking machine to accommodate threaded rods of various different lengths, the rods may be guided down the supply ramp 88 by a pair of adjustable end guide plates, and the end guide plates and the corresponding pair of end cradle rollers 92 may be adjustable axially relative to the center pair of cradle rollers 92 and the marking head 85. As an alternative, the marking machine may be constructed so that one pair of end cradle rollers 92 is fixed and the opposite end pair of cradle rollers 92 is adjustable axially according to the length of the threaded rods being supplied. In this construction, the supports for the center pair of cradle rollers 92 and for the marking or printing head 85 are supported for axial movement equal to one half of the axial movement of the movable end pair of cradle rollers 92. This relative adjustability is provided by the use of separate lead screws for each of the movable components, with the lead screws being connected by an endless chain for simultaneous rotation at a 2 to 1 ratio.

Figure 9:
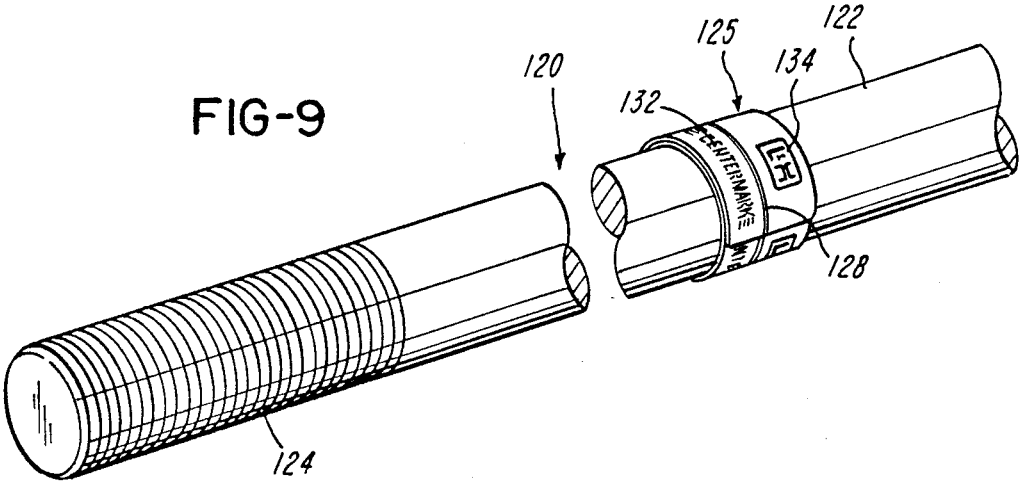
FIG. 9 is a fragmentary perspective view of a threaded rod and showing the marking of the rod in accordance with a modification of the invention.
Figure 10:
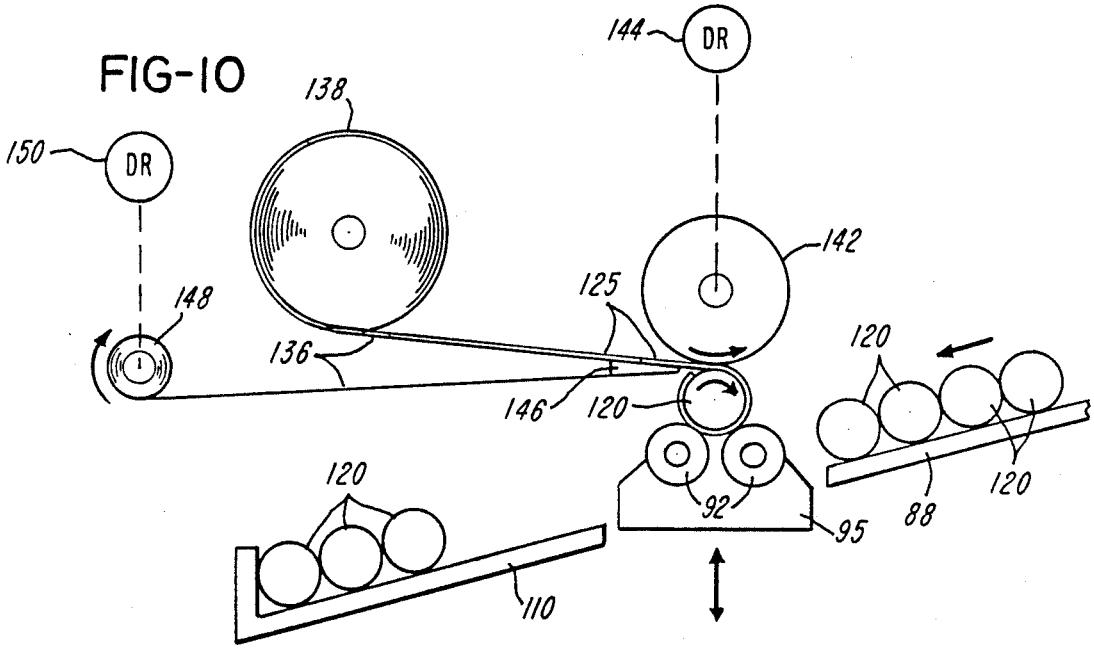
FIG. 10 is a diagrammatic view similar to FIG. 7 and illustrating the marking of the rod shown in FIG. 9.

Referring to FIGS. 9 and 10 which illustrate another embodiment of the invention, a cylindrical metal or steel rod 120 has a center portion 122 with a smooth outer surface and opposite threaded end portions 124. The longitudinal center of the rod 120 is marked by a pressure sensitive adhesive label 125 which is wrapped around the rod 120 with overlapping end portions. The label 125 is printed with a longitudinally extending line 128 of color contrasting ink and forms a circumferentially extending stripe or mark on the rod 120 within a radially extending center plane. The label 125 is also repetitively printed with other information which may be in the form of trademarks 132 and 134. The thickness of the label 125 is exaggerated in FIG. 9 for purpose of illustration.

As shown in FIG. 10, a succession of preprinted and die-cut labels 125 are releasably carried by a carrier strip 136, and the combined strip and labels are supplied in a roll 138. The pressure sensitive labels 125 are successively attached to the center portions 122 of the rods 120 with the aid of a transfer mechanism as described above in connection with FIG. 7.

After each rod 120 is elevated to the resilient outer surface of an applicator wheel 142 driven by a motor 144, a label 125 is peeled or separated from the carrier strip 136 around the peel edge of a stripping blade or member 146. The carrier strip 136 is pulled around the member 146 by a rewind core or spool 148 driven by a motor 150 in timed relation with the vertical movement of the transfer carriage 95. The applicator wheel 142 is also rotated in timed relation with the rewind spool 148 so that each label 125 is pressed into firm contact with the outer cylindrical surface of a rod 120 as the label is peeled from the carrier strip 136 and wrapped onto the rod.

From the drawing and the above description, it is apparent that large diameter threaded rods produced in accordance with the invention for making heavy duty U-bolts, provide desirable features and advantages. As a primary advantage, the mark identifying the longitudinal center of each rod provides for quickly and accurately locating each rod within a U-bolt bending machine and thereby provides for more efficiently producing U-bolts. The center indicating mark on each rod also eliminates the problem of inaccurately measuring each rod to locate the center of the rod and the problem of adjusting a stop for positioning one end of each rod within the bending machine, thereby significantly reducing the production of defective or scrap U-bolts.

Another advantage is provided by extending the rod center indicator or mark around the circumference of the rod, such as the mark 20 or 84 or 128, so that each rod may be quickly located within the bending machine without requiring that the rod be rotated to locate a center identifyng mark. In addition, the color contrasting ink forming the center indicating mark 84 or 128, provides for a permanent identification which may not be inadvertently removed. As mentioned above, the rod center identifying mark may also be used to identify the heat number for the steel forming the rod and/or to provide other information such as the manufacturer of the steel or date of marking.

While the methods of producing threaded metal rods for forming U-bolts and the construction of the rods herein described constitute preferred embodiments of the invention, it is to be understood that the invention is not limited to these precise methods and rod constructions, and that changes may be made therein without departing from the scope and spirit of the invention as defined in the appended claims. For example, each rod may be provided with a center indicating mark by stamping or marking only a center portion of the rod surface in place of the mark 20 or 84 or 128 which extends around the circumference of the rod.

The invention having thus been described, the following is claimed:

1. A method of efficiently producing heavy duty U-bolts of different sizes, wherein each U-bolt has two legs of substantially equal length, the method comprising the steps of forming a supply of elongated straight cylindrical metal rods having opposite ends, smooth cylindrical outer surfaces and different predetermined lengths, forming helical threads on opposite end portions of each rod, successively feeding the straight metal rods into a marking machine having means for applying to the rods adhesive labels with visually perceptible marks, successively marking the outer surfaces of the rods with the applying means by attaching adhesive labels having marks located at substantially the radially extending center plane of each rod to produce a visually perceptible mark at the longitudinal center of each rod, successively transferring the rods from the marking machine, inserting each rod for bending into a forming machine having a mandrel supported between two bending members, the mandrel and the bending members being relatively movable with respect to each other, the mandrel having a surface for supporting the center portion of each rod during bending, locating each rod within the forming machine with the visually perceptible mark on the longitudinal center of the rod aligned with a visual reference indicative of a center plane of the forming machine, and moving the mandrel and the bending members with respect to each other to bend each rod around the mandrel surface, with the bending members engaging the rod in an area spaced longitudinally from the visually perceptible mark on each rod, thereby producing a U-bolt having two legs of substantially equal length from each rod and a supply of U-bolts differing in leg length size from each other, and with minimum scrap resulting from differing leg lengths in a single U-bolt.

2. A method as defined in claim 1 wherein the step of marking the rods comprises the steps of wrapping each label around a rod and overlapping the end portions of the label.

3. A method as defined in claim 1 wherein the rods are transferred laterally relative to the marking machine for successively marking the rods.

4. A method as defined in claim 1 and including the step of rotating each rod with a label applying wheel during the marking of each rod.

5. A method of efficiently producing heavy duty U-bolts of different sizes, wherein each U-bolt has two legs of substantially equal length, the method comprising the steps of forming a supply of elongated straight cylindrical metal rods having opposite ends, smooth cylindrical outer surfaces and different predetermined lengths, forming helical threads on opposite end portions of each rod, successively feeding the straight metal rods into a marking machine having means for applying to the rods adhesive labels with visually perceptible marks, successively marking the outer surfaces of the rods with the applying means by attaching adhesive labels having circumferentially extending printed stripes at substantially the radially extending center plane of each rod to produce a visually perceptible mark at the longitudinal center of each rod, successively transferring the rods from the marking machine, inserting each rod for bending into a forming machine having a mandrel supported between two bending members, the mandrel and the bending members being relatively movable with respect to each other, the mandrel having a surface for supporting the center portion of each rod during bending, locating each rod within the forming machine with the stripe on the longitudinal center of the rod aligned with a visual reference indicative of a center plane of the forming machine, and moving the mandrel and the bending members with respect to each other to bend each rod around the mandrel surface, with the bending members engaging the rod in an area spaced longitudinally from the stripe on each rod, thereby producing a U-bolt having two legs of substantially equal length from each rod and a supply of U-bolts differing in leg length size from each other, and with minimum scrap resulting from differing leg lengths in a single U-bolt.

* * * * *